US007281456B2

(12) United States Patent
Chiang

(10) Patent No.: US 7,281,456 B2
(45) Date of Patent: Oct. 16, 2007

(54) TOOL SET

(75) Inventor: Wei Chiang, Taipei (TW)

(73) Assignee: Giant Manufacturing Co., Ltd., Taichung (TW)

( * ) Notice: Subject to any disclaimer, the term of this patent is extended or adjusted under 35 U.S.C. 154(b) by 0 days.

(21) Appl. No.: 11/317,052

(22) Filed: Dec. 27, 2005

(65) Prior Publication Data

US 2007/0144314 A1 Jun. 28, 2007

(51) Int. Cl.
*B25F 1/04* (2006.01)
*B25B 23/00* (2006.01)
*B25B 23/16* (2006.01)

(52) U.S. Cl. ..... 81/440; 81/177.4; 7/168; 7/138

(58) Field of Classification Search ..... 81/440, 81/177.4, 177.6, 124.4; 7/138, 165, 168
See application file for complete search history.

(56) References Cited

U.S. PATENT DOCUMENTS 5,711,042 A * 1/1998 Chuang ..... 7/138
5,996,451 A * 12/1999 Seber et al. ..... 81/427.5
6,286,168 B1 * 9/2001 Woodruff et al. ..... 7/138
6,397,709 B1 * 6/2002 Wall ..... 81/440
6,574,817 B2 * 6/2003 Wu ..... 7/138
6,622,329 B2 * 9/2003 Ostor et al. ..... 7/138
6,751,819 B2 * 6/2004 Chuang ..... 7/100
6,988,288 B2 * 1/2006 Wang ..... 7/138
7,047,847 B2 * 5/2006 Chuang ..... 81/440
7,146,889 B2 * 12/2006 Kang ..... 81/437

* cited by examiner

*Primary Examiner*—David B Thomas
(74) *Attorney, Agent, or Firm*—Harness, Dickey & Pierce, P.L.C.

(57) ABSTRACT

A tool set includes a pivot unit extending in a first direction, and at least two tool units, each of which includes two tool members attached rotatably to the pivot unit. Each of the tool members includes a tool head, a tool body connected to the tool head and extending in a second direction transverse to the first direction, and a connecting head connected to the tool body and having the pivot unit extending rotatably therethrough. The tool members of each of the tool units are disposed adjacent to each other such that the tool bodies of the tool members are disposed side by side in a third direction transverse to the first and second directions, and such that the connecting heads of the tool members are disposed side by side in the first direction.

7 Claims, 10 Drawing Sheets

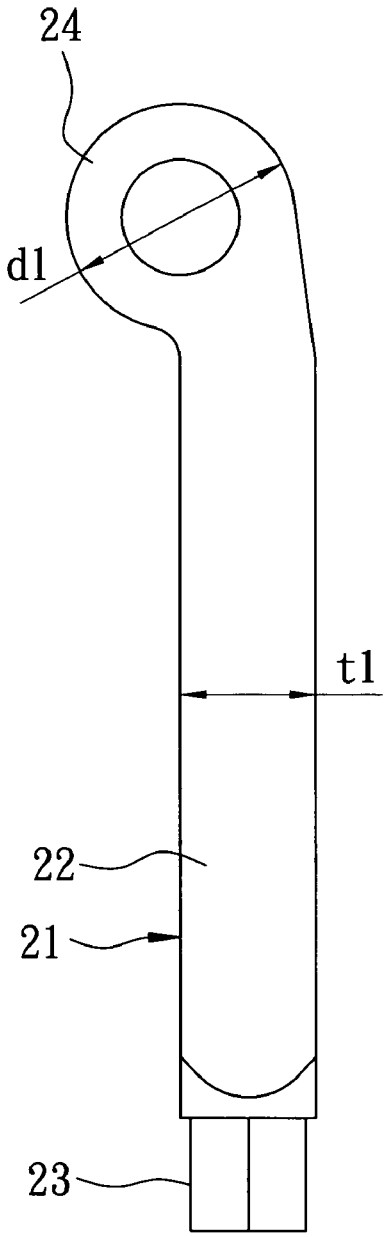
FIG. 6
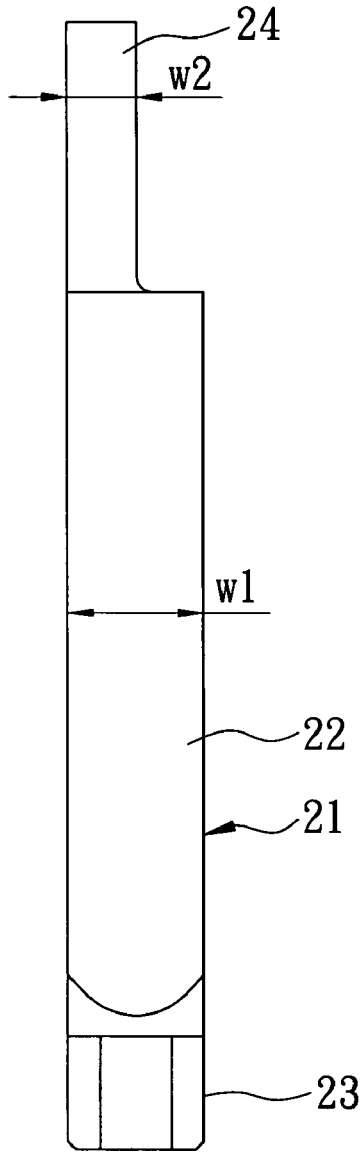
FIG. 7
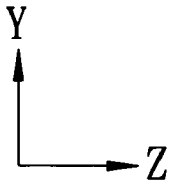
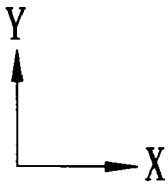

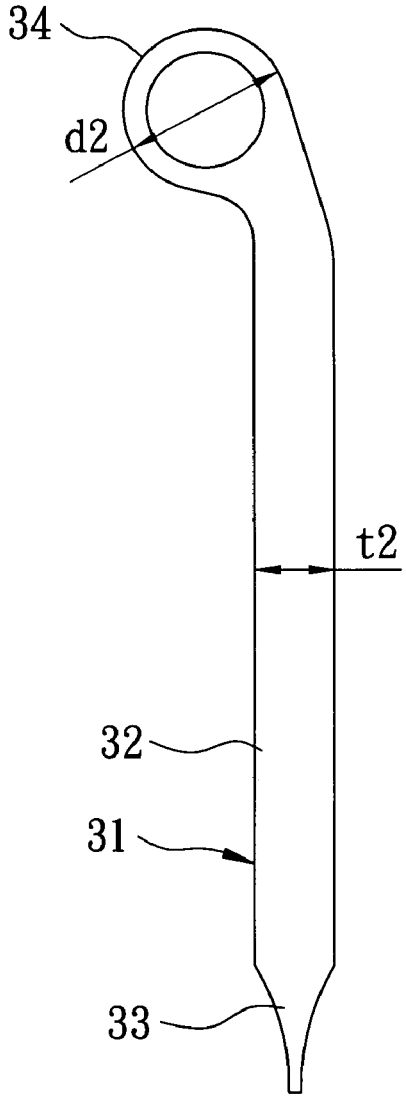
FIG. 8
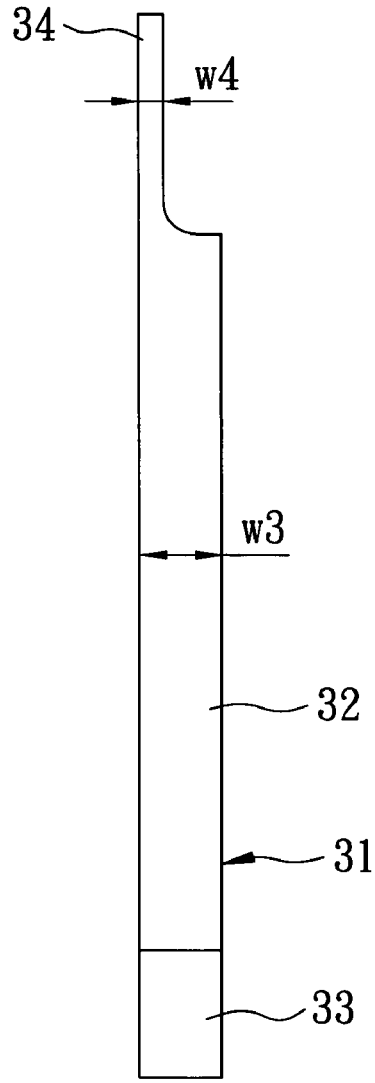
FIG. 9
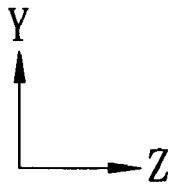
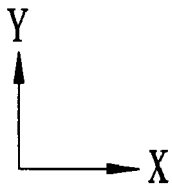

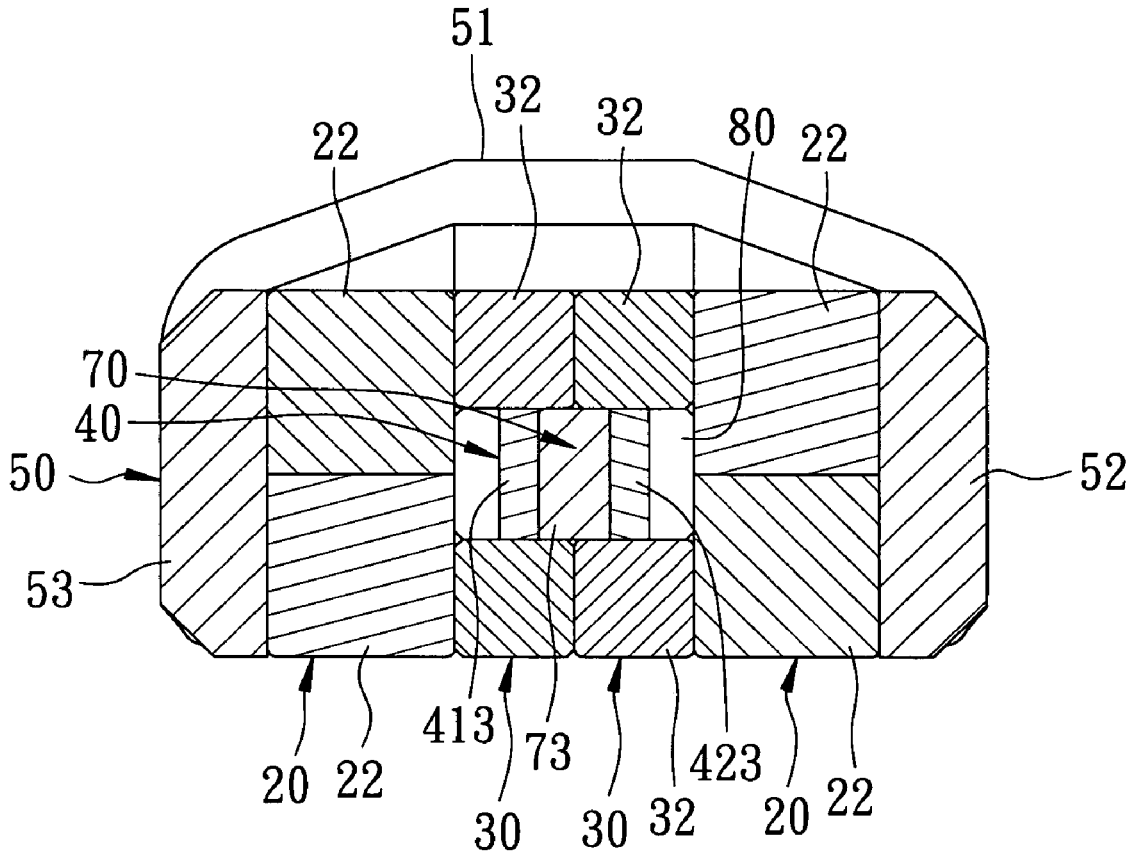
FIG. 10
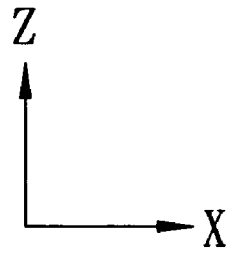

TOOL SET

BACKGROUND OF THE INVENTION

1. Field of the Invention

The invention relates to a tool, more particularly to a tool set that is both compact and easy to use.

2. Description of the Related Art

As shown in FIG. 1, a conventional tool set 10 includes a base unit 11, first and second pivot units 14, 15, and two sets of first and second tool members 12, 13 attached rotatably to the first and second pivot units 14, 15, respectively.

The base unit 11 includes a main plate 111, and two side plates 112 extending from the main plate 111 in a direction transverse to the main plate 111. Each of the side plates 112 has first and second connecting portions 113, 114 that are spaced apart from each other.

Each of the first and second pivot units 14, 15 includes a bolt 141, 151 extending through a respective one of the first and second connecting portions 113, 114 of the side plates 112, and a nut 142, 152 connected threadedly to the bolt 141, 151 of the corresponding one of the first and second pivot units 14, 15.

Each of the first and second tool members 12, 13 includes a tool body 121, 131, a connecting head 122, 132, and a tool head 123, 133. The tool bodies 121, 131 have different cross-sectional sizes and many differ in length. The connecting heads 122, 132 are formed by bending the respective one of the tool bodies 121, 131 at one end such that the first and second tool members 12, 13 are configured respectively with openings 124, 134 for extension of a respective one of the first and second pivot units 14, 15 there through. The tool heads 123, 133 have various shapes such that the conventional tool set 10 can be used for screws with different head configurations.

To assemble the conventional tool set 10, the first tool members 12 are disposed between the side plates 112 with the connecting heads 122 aligned with the first connecting portions 113. Next, the bolt 141 of the first pivot unit 14 is extended sequentially through the first connecting portion 113 of one of the side plates 112, the openings 124 of the first tool members 12, and the connecting portion 113 of the other one of the side plates 112 such that the first tool members 12 are rotatable relative to the bolt 141 of the first pivot unit 14. Then, the nut 142 is engaged threadedly to the bolt 141 to secure the connecting heads 122 of the first tool members 12 between the side plates 112. Similarly, the second tool members 13 are disposed between the side plates 112 with the connecting heads 132 aligned with the second connecting portions 114. Next, the bolt 151 of the second pivot unit 15 is extended sequentially through the second connecting portion 114 of one of the side plates 112, the openings 134 of the second tool members 13, and the connecting portion 114 of the other one of the side plates 112 such that the second tool members 13 are rotatable relative to the bolt 151 of the second pivot unit 15. Then, the nut 152 is engaged threadedly to the bolt 151 to secure the connecting heads 132 of the second tool members 13 between the side plates 112.

Under a storage state (not shown) of the conventional tool set 10, the tool bodies 121 of the first tool members 12 are disposed proximate to the main plate 111 of the base unit 11, while the tool bodies 131 of the second tool members 13 are disposed proximate to the first tool members 12 and are spaced apart from the main plate 111.

Although the conventional tool set 10 is capable of driving screws with various head configurations, it has the following shortcomings:

1. The second tool members 13 need to be pivoted away from the main plate 111 of the base unit 11 before any of the first tool members 12 can be used.

2. Since the connecting heads 122 of the first tool members 12 are disposed side by side in sequence, which is also true for the connecting heads 132 of the second tool members 13, size of the conventional tool set 10 is relatively large, which can result in inconvenient storage and transport.

3. In addition to the conventional tool set 10, a bike rider needs to carry a separate chain repair tool (not shown) in order to repair bike chains, which is also inconvenient.

SUMMARY OF THE INVENTION

Therefore, the object of the present invention is to provide a tool set that is both compact and easy to use.

According to the present invention, there is provided a tool set that includes a pivot unit extending in a first direction, and at least two tool units, each of which includes two tool members attached rotatably to the pivot unit. Each of the tool members includes a tool head, a tool body connected to the tool head and extending in a second direction transverse to the first direction, and a connecting head connected to the tool body and having the pivot unit extending rotatably therethrough. The tool body of each of the tool members has a first width in the first direction, and a thickness in a third direction transverse to the first and second directions. The connecting head of each of the tool members has a second width in the first direction not greater than one-half of the first width, and an outer diameter not smaller than twice the thickness. The tool members of each of the tool units are disposed adjacent to each other such that the tool bodies of the tool members are disposed side by side in the third direction, and such that the connecting heads of the tool members are disposed side by side in the first direction.

BRIEF DESCRIPTION OF THE DRAWINGS

Other features and advantages of the present invention will become apparent in the following detailed description of the preferred embodiment with reference to the accompanying drawings, of which:

FIG. 6 is a side view of a first tool member according to the preferred embodiment;

FIG. 7 is a front view of the first tool member of FIG. 6;

FIG. 8 is a side view of a second tool member according to the preferred embodiment;

FIG. 9 is a front view of the second tool member of FIG. 8;

FIG. 10 is a sectional view of the preferred embodiment taken along line X-X in FIG. 3;

DETAILED DESCRIPTION OF THE PREFERRED EMBODIMENT

Figure 1:
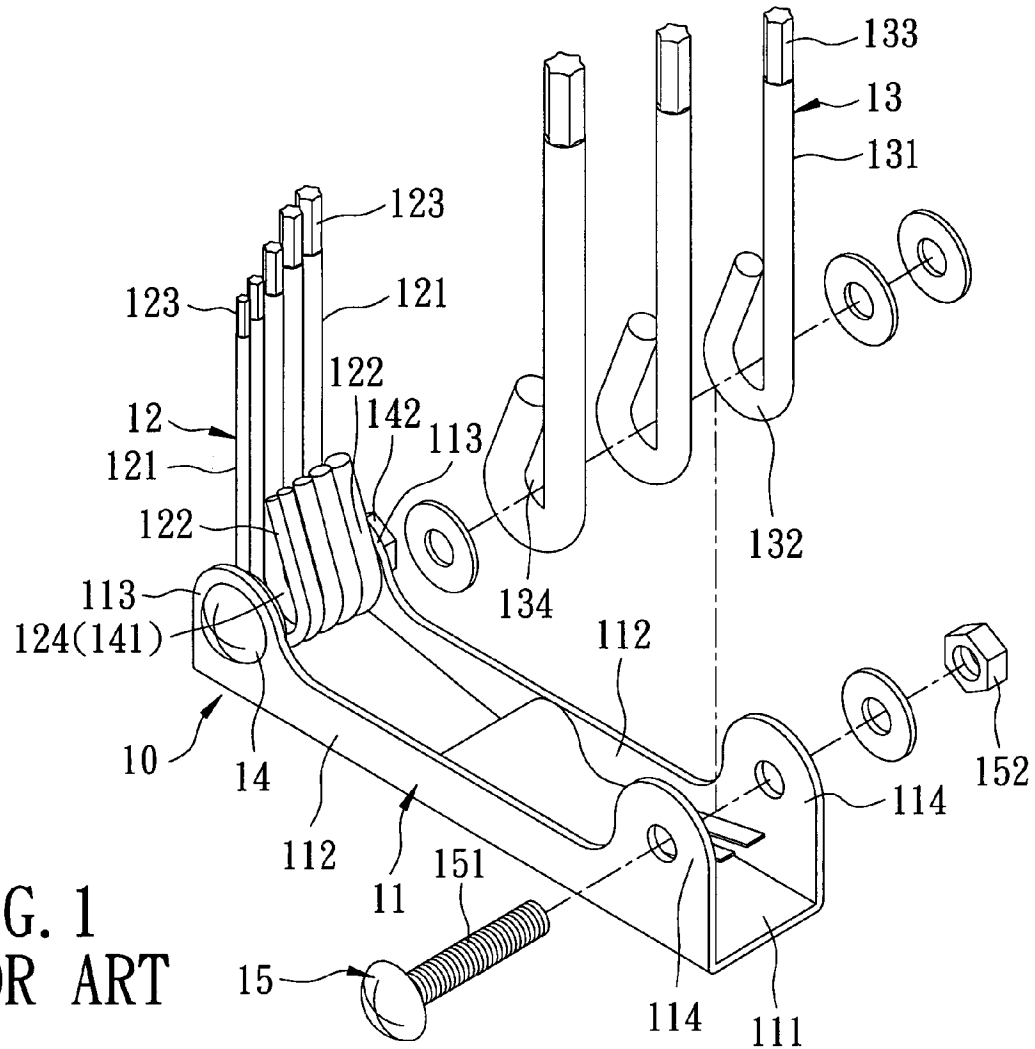
FIG. 1 PRIOR ART
FIG. 1 is a partly-exploded perspective view of a conventional tool set.
Figure 2:
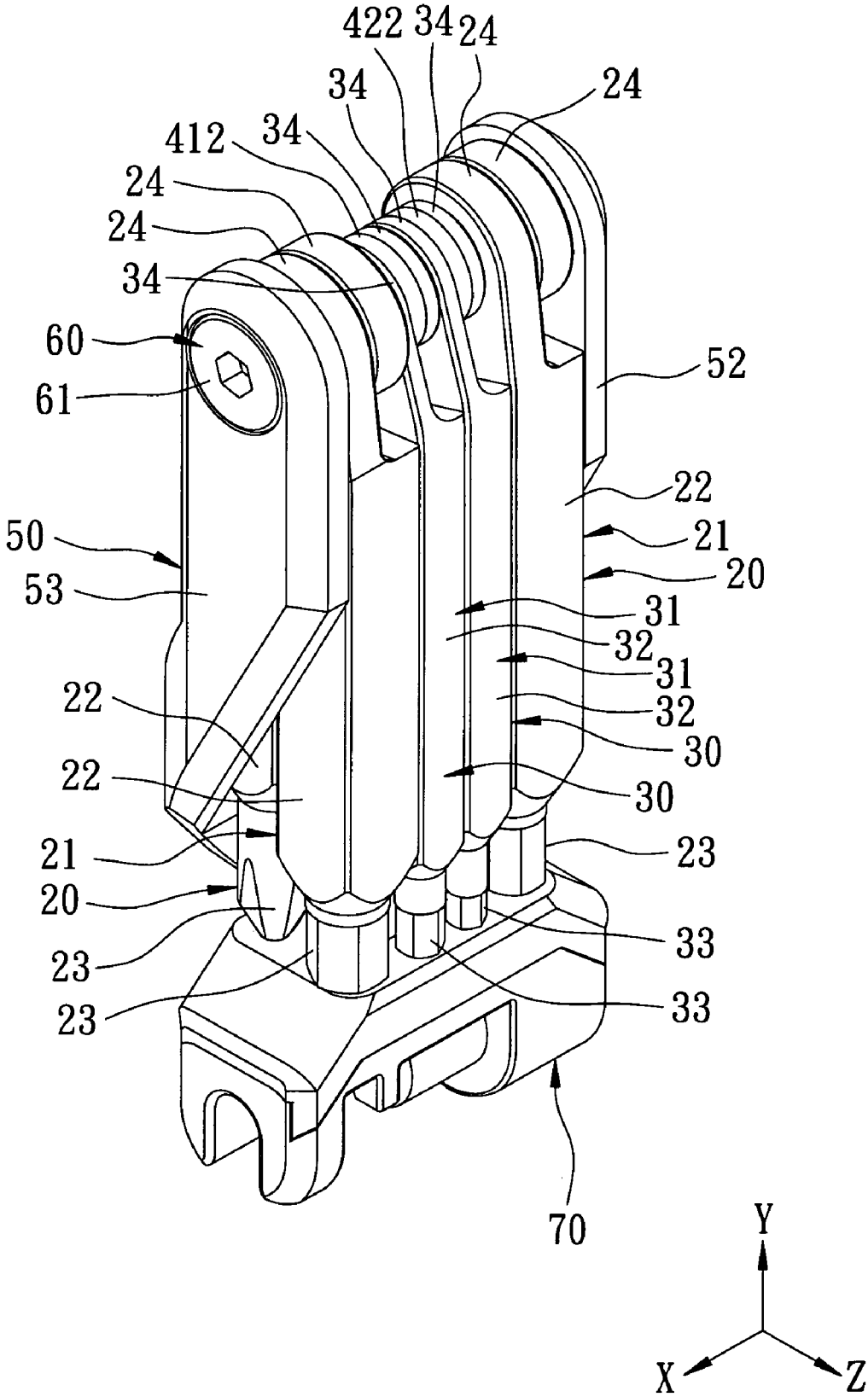
FIG. 2 is an assembled perspective view of the preferred embodiment of a tool set according to the present invention.
Figure 5:
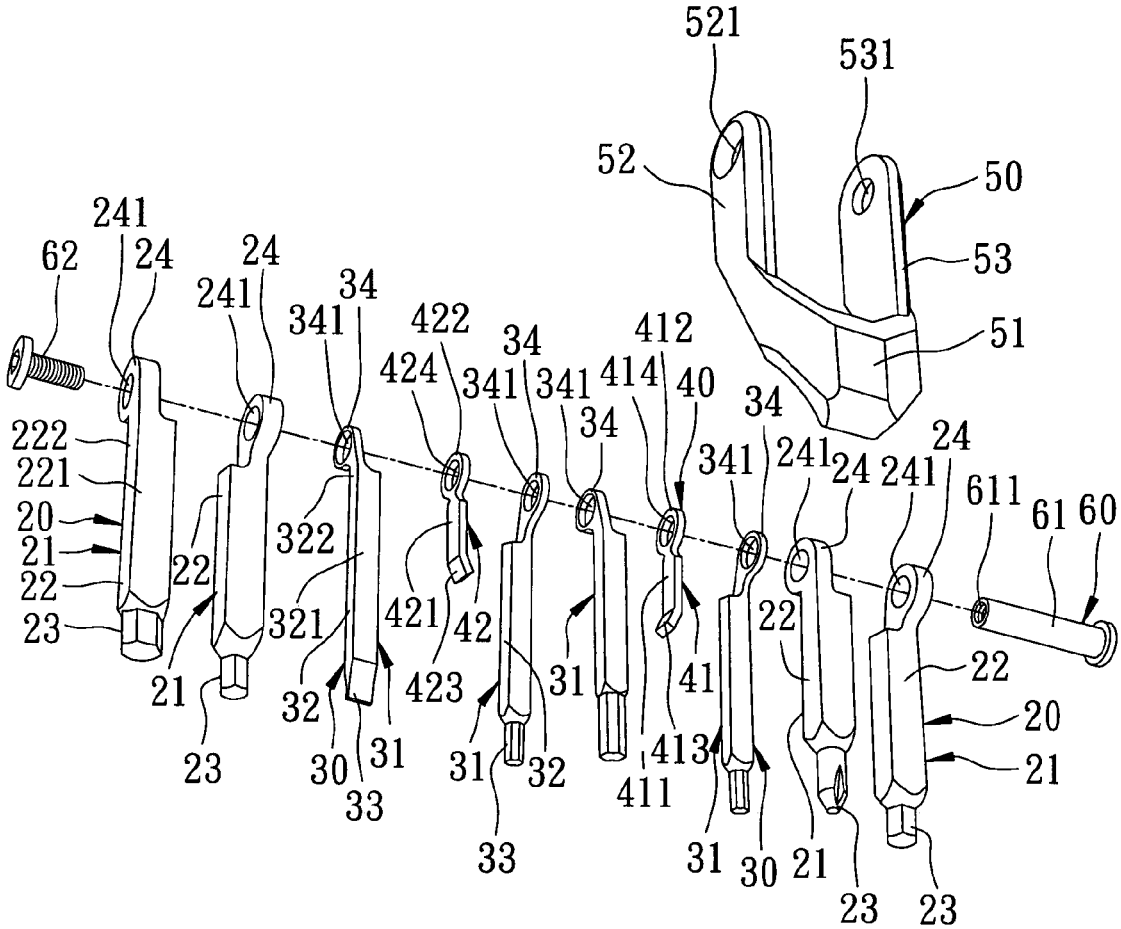
FIG. 5 is an exploded perspective view of the preferred embodiment.
Figure 5:
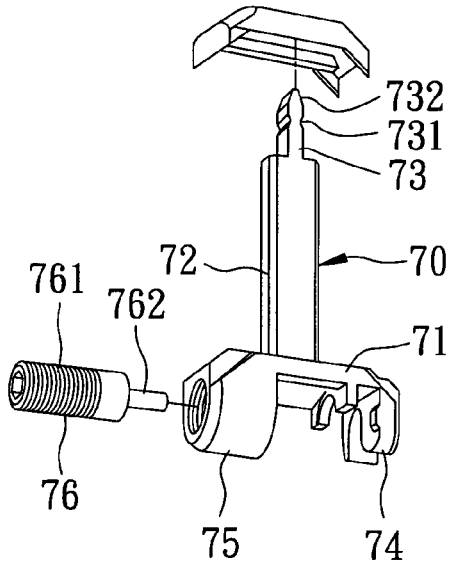
Figure 5:
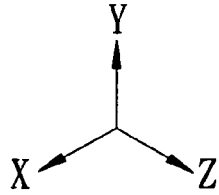

As shown in FIG. 2 and FIG. 5, the preferred embodiment of a tool set according to the present invention includes a pivot unit 60, two first tool units 20, two second tool units 30, a clamping unit 40, a chain repair tool 70, and a cover member 50.

The pivot unit 60 extends in a first direction (X), and includes a hollow shaft 61 and a bolt member 62. The hollow shaft 61 is formed with an internal thread 611 for threaded engagement with the bolt member 62.

Each of the first tool units 20 includes two first tool members 21 attached rotatably to the pivot unit 60. Each of the first tool members 21 includes a first tool head 23, a first tool body 22 connected to the first tool head 23 and extending in a second direction (Y) transverse to the first direction (X), and a first connecting head 24 connected to the first tool body 22 and having the pivot unit 60 extending rotatably therethrough. In particular, the first tool body 22 has first and second walls 221, 222 that extend along the second direction (Y) and that are perpendicular to each other. The first connecting head 24 is formed by extending the first and second walls 221, 222 in the second and third directions (Y), (Z), and is formed with a first pivot-extension hole 241 that opens in the first direction (X). The first tool heads 23 of the first tool members 21 can be made into shafts with various cross-sectional shapes so as to permit insertion into fasteners (e.g. screws) with bit-receiving recesses of different shapes.

As shown in FIG.6 and FIG.7, the first tool body 22 of each of the first tool members 21 has a first width (w1) in the first direction (X), and a first thickness (t1) in a third direction (Z) transverse to the first and second directions (X), (Y). The first connecting head 24 of each of the first tool members 21 has a second width (w2) in the first direction (X) not greater than one-half of the first width (w1), i.e., w2≦½w1, and a first outer diameter (d1) not smaller than twice the first thickness (t1), i.e., d1>2t1. In this embodiment, the second width (w2) equals one-half of the first width (w1), i.e., w2=½w1, and the first outer diameter (d1) equals twice the first thickness (t1), i.e., d1=2t1.

The first tool members 21 of each of the first tool units 20 are disposed adjacent to each other such that the first tool bodies 22 of the first tool members 21 are disposed side by side in the third direction (Z), and such that the first connecting heads 24 of the first tool members 21 are disposed side by side in the first direction (X). With this particular arrangement, the first connecting heads 24 of the first tool members 21 have a total width (w2+w2) that equals the first width (w1) of the first tool bodies 22 of the first tool members 21, i.e., w2+w2=w1. The first tool bodies 22 of the first tool members 21 have a total thickness (t1+t1) that equals the first outer diameter (d1) of the first connecting heads 24 of the first tool members 21, i.e., t1+t1=d1. This enhances overall aesthetic appeal of the tool set, and reduces the size of the tool set so as to facilitate storage and transport thereof.

Referring again to FIG. 2 and FIG. 5, the second tool units 30 are disposed between the first tool units 20. Each of the second tool units 30 includes two second tool members 31 attached rotatably to the pivot unit 60.

Each of the second tool members 31 includes a second tool head 33, a second tool body 32 connected to the second tool head 33 and extending in the second direction (Y), and a second connecting head 34 connected to the second tool body 32 and having the pivot unit 6 extending rotatably therethrough. In particular, the second tool body 32 has third and fourth walls 321, 322 that extend along the second direction (Y), and that are perpendicular to each other. The second connecting head 34 is formed by extending the third and fourth walls 321, 322 in the second and third directions (Y), (Z), and is formed with a second pivot-extension hole 341 that opens in the first direction (X). The second tool heads 33 of the second tool members 31 can be made into shafts with various cross-sectional shapes so as to permit insertion into fasteners (e.g. screws) with bit-receiving recesses of different shapes.

As shown in FIG.8 and FIG.9, the second tool body 32 of each of the second tool members 31 has a third width (w3) in the first direction (X), and a second thickness (t2) in the third direction (Z). The second connecting head 34 of each of the second tool members 31 has a fourth width (w4) in the first direction (X) not greater than one-third of the third width (w3), i.e., w4≦⅓w3, and a second outer diameter (d2) not smaller than twice the second thickness (t2), i.e., d2≦2t2. In this embodiment, the fourth width (w4) equals one-third of the third width (w3), i.e., w4=⅓w3, and the second outer diameter (d2) equals twice the second thickness (t2), i.e., d2=2t2.

Moreover, the third width (w3) of the second tool body 32 is smaller than the first width (wi) of the first tool body 22, i.e., w3<w1. The second thickness (t2) of the second tool body 32 is smaller than the first thickness (t1) of the first tool body 22, i.e., t2<t1.

Referring further to FIG.10, the second tool bodies 32 of the second tool members 31 of the second tool units 30 cooperate with the first tool bodies 22 of the first tool members 21 of the first tool units 20 to confine a retaining space 80 there among.

Figure 3:
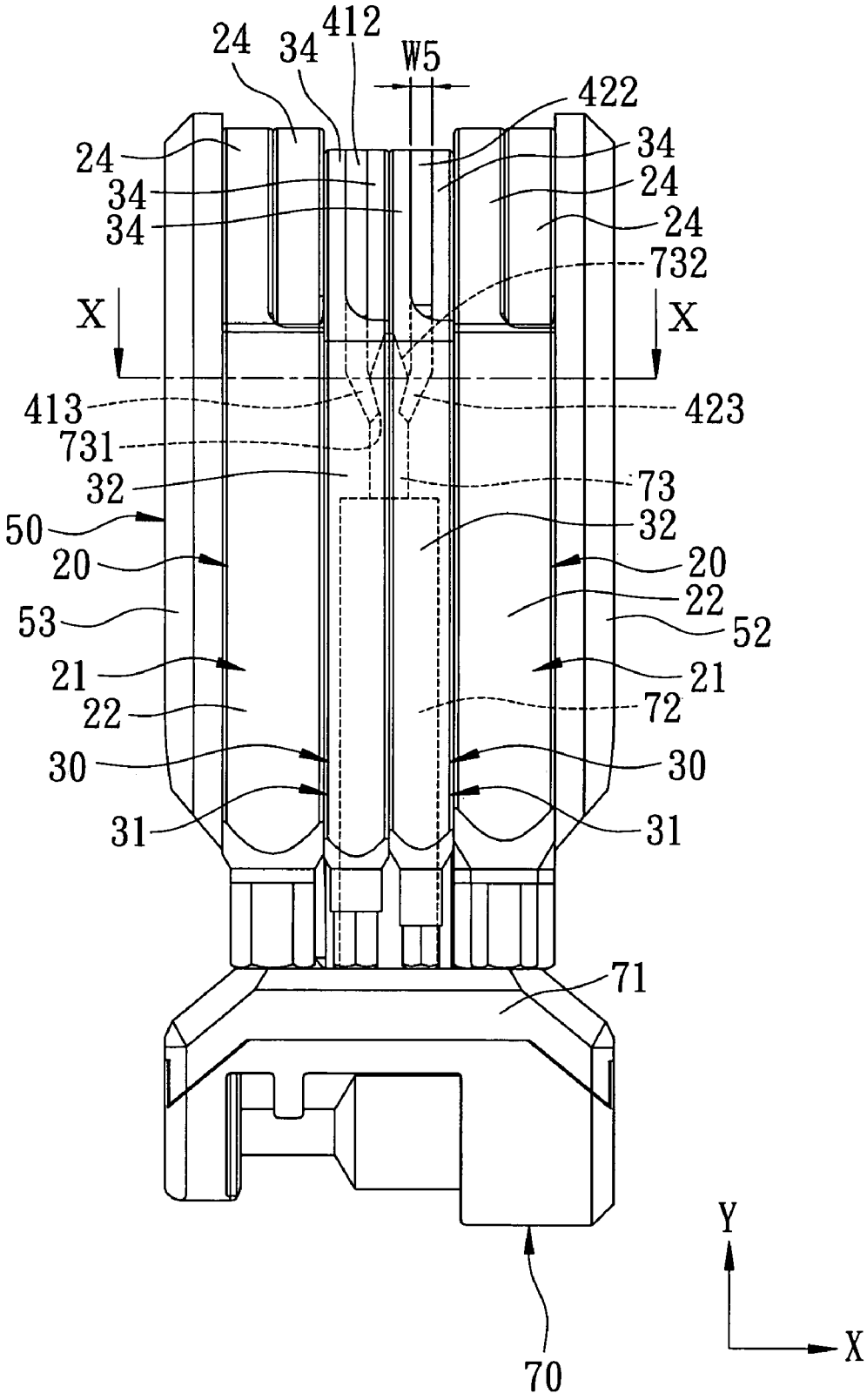
FIG. 3 is a front view of the preferred embodiment, illustrating a chain repair tool in a retained state.

As best shown in FIG.3, FIG.5 and FIG.10, the clamping unit 40 is disposed in the retaining space 80, and includes first and second clamping members 41, 42. The first and second clamping members 41, 42 include first and second clamping portions 413, 423, first and second clamp bodies 411, 421, and first and second pivot connecting portions 412, 422, respectively. The first and second clamp bodies 411, 421 extend in the second direction (Y), and are connected respectively to the first and second clamping portions 413, 423. The first and second pivot connecting portions 412, 422 are connected respectively to the first and second clamp bodies 411, 421, and have the pivot unit 60 extending rotatably therethrough. The first and second clamping portions 413, 423 of the first and second clamping members 41, 42 extend toward each other in the retaining space 80. The first and second pivot connecting portions 412, 422 are formed with first and second connecting holes 414, 424 that open in the first direction (X), respectively.

Each of the first and second pivot connecting portions 412, 422 of the first and second clamping members 41, 42 has a fifth width (w5) (see FIG.3) in the first direction (X) not greater than one-third of the third width (w3), i.e., w5≦⅓w3, and is disposed between the second connecting heads 34 of the second tool members 31 of a respective one of the second tool units 30. In this embodiment, the fifth width (w5) equals one-third of the third width (w3), i.e., w5=⅓w3.

As shown in FIG. 3, FIG. 5 and FIG. 10, the chain repair tool 70 extends removably into the retaining space 80 and is clamped removably by the clamping portions 413, 423 of the first and second clamping members 41, 42. The chain repair tool 70 includes a base 71, a post body 72, a retaining portion 73, a chain-positioning seat 74, an internally threaded seat 75, and a pin-removing component 76. The base 71 extends in the first direction (X). The post body 72 is connected to the base 71, and extends in the second direction (Y). The retaining portion 73 is connected to the tool body 72, extends removably into the retaining space 80 in the second direction (Y), and is clamped removably by the clamping portions 413, 423 of the first and second clamping members 41, 42. The chain-positioning seat 74 is formed on the base 71 and is disposed distal from the retaining portion 73. The internally threaded seat 75 is formed on the base 71, and is spaced apart from the chain-positioning seat 74. The pin-removing component 76 is mounted threadedly on the internally threaded seat 75 and is operable for movement toward and away from the chain-positioning seat 74 in the first direction (X).

Figure 12:
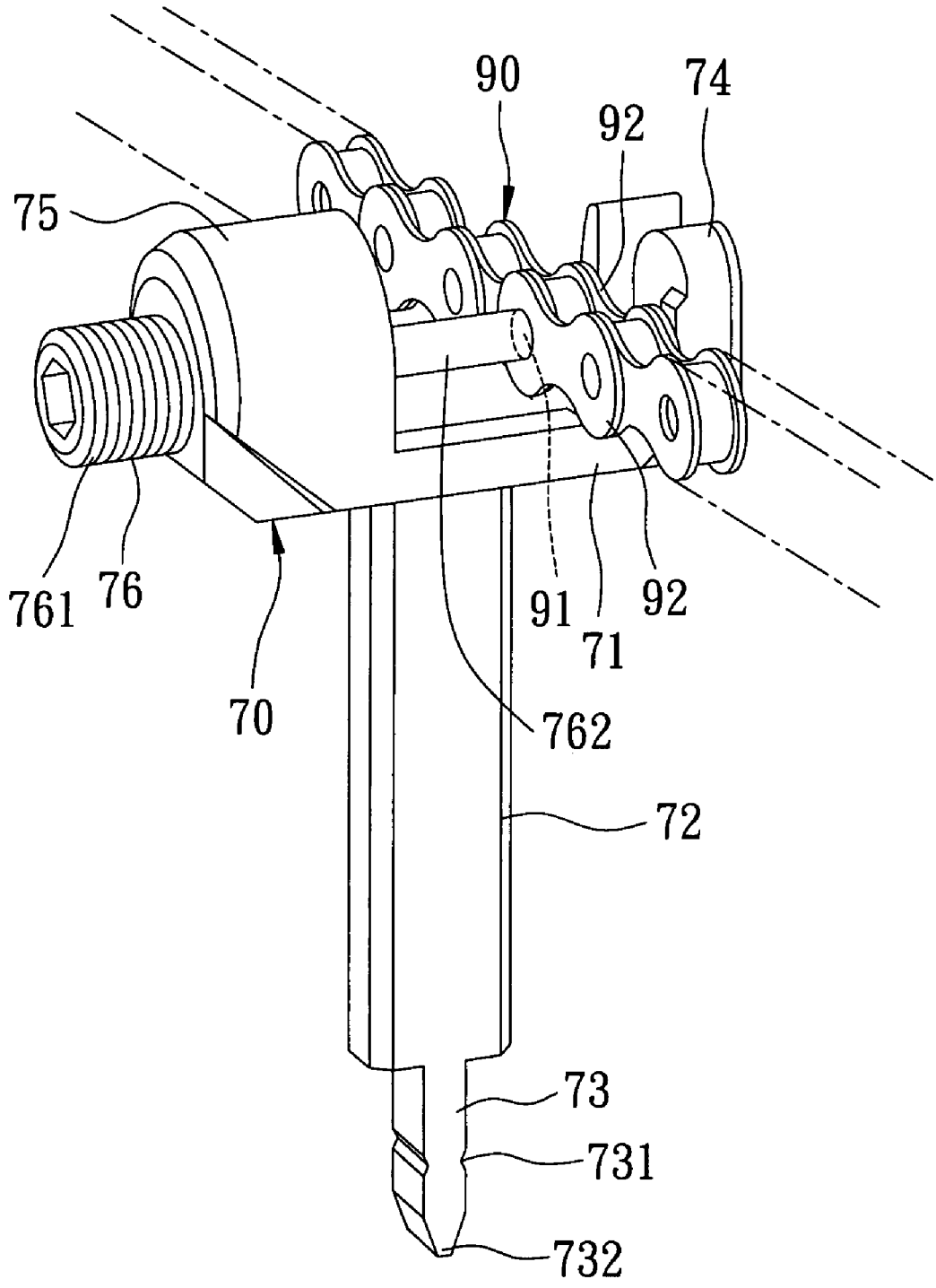
FIG. 12 is a perspective view of the chain repair tool according to the preferred embodiment when applied to a bike chain for removal of a pin.

With further reference to FIG. 12, in this embodiment, the retaining portion 73 of the chain repair tool 70 is formed with a tapering tip 732 and a restricted neck 731 proximate to the tapering tip 732 to engage the clamping portions 413, 423 of the first and second clamping members 41, 42. The pin-removing component 76 has a threaded portion 761 that engages threadedly the internally threaded seat 75, and an urging portion 762 connected to the threaded portion 761 and extending in the first direction (X) for removal of a pin 91 of a bike-chain 90.

Figure 4:
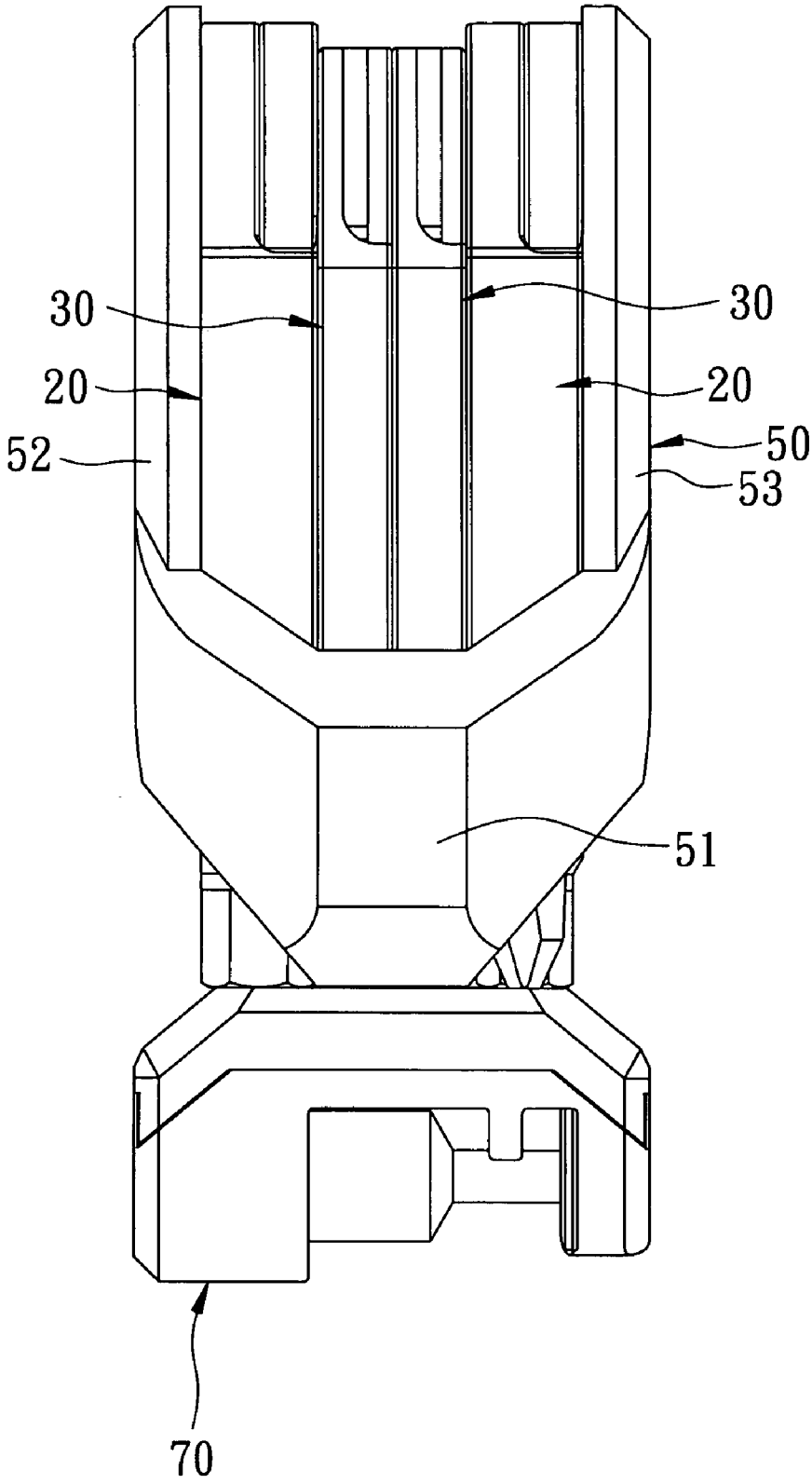
FIG. 4 is a back view of the preferred embodiment.

As shown in FIG. 4, FIG. 5 and FIG. 10, the cover member 50 includes first and second wing portions 52, 53, and a connecting portion 51. The first and second wing portions 52, 53 extend in the second direction (Y), are mounted rotatably to the pivot unit 60, and have the first tool units 20 disposed therebetween. The connecting portion 51 extends in the first direction (X) and interconnects the first and second wing portions 52, 53. The first and second wing portions 52, 53 are formed respectively with first and second pivot-extension openings 521, 531 that open in the first direction (X).

As shown in FIG. 2, FIG. 3 and FIG. 5, during assembly, the hollow shaft 61 of the pivot unit 6 is extended sequentially through the second pivot-extension opening 531 in the second wing portion 53 of the cover member 50, the first pivot-extension holes 241 in the first connecting heads 24 of the first tool members 21 of one of the first tool units 20, the second pivot-extension hole 341 in the second connecting head 34 of one of the second tool members 31 of a first one of the second tool units 30, the first connecting hole 414 in the first pivot connecting portion 413 of the first clamping member 41 of the clamping unit 40, the second pivot-extension hole 341 in the second connecting head 34 of the other one of the second tool members 31 of the first one of the second tool units 30, the second pivot-extension hole 341 in the second connecting head 34 of one of the second tool members 31 of the second one of the second tool units 30, the second connecting hole 424 in the second pivot connecting portion 423 of the second clamping member 42 of the clamping unit 40, the second pivot-extension hole 341 in the second connecting head 34 of the other one of the second tool members 31 of the second one of the second tool units 30, the first pivot-extension holes 241 in the first connecting heads 24 of the first tool members 21 of the other one of the first tool units 20, and the first pivot-extension opening 521 in the first wing portion 52 of the cover member 50. The bolt member 62 of the pivot unit 60 then engages threadedly the internal thread 611 of the hollow shaft 61 such that the first and second tool units 20, 30 and the clamping unit 40 are confined between the first and second wing portions 52, 53 of the cover unit 50, and such that the first and second tool units 20, 30, the clamping unit 40 and the cover unit 50 are rotatable relative to the pivot unit 60.

As shown in FIGS. 2, 3, 4 and 10, after assembly, the first tool members 21 of each of the first tool units 20 are disposed adjacent to each other such that the first tool bodies 22 of the first tool members 21 are disposed side by side in the third direction (Z), and such that the first connecting heads 24 of the first tool members 21 are disposed side by side in the first direction (X). The second tool members 31 of each of the second tool units 30 are disposed adjacent to a respective one of the first and second clamping members 41, 42 such that the second tool bodies 32 of the second tool members 31 and the corresponding clamp body 411, 421 of the respective one of the first and second clamping members 41, 42 are aligned in the third direction (Z), and such that the second connecting heads 34 of the second tool members 31 and the corresponding pivot connecting portion 413, 423 of the respective one of the first and second clamping members 41, 42 are aligned in the first direction (X).

As shown in FIG. 3 and FIG. 10, to move the chain repair tool 70 to a retained state, the post body 72 and the retaining portion 73 are extended into the retaining space 80 until the tapering tip 732 is extended between the first and second clamping members 41, 42 such that the clamping portions 413, 423 of the first and second clamping members 41, 42 provide forces toward each other for clamping the restricted neck 731 therebetween. Therefore, transport of the tool set is facilitated since the chain repair tool 70 is no longer a separate component.

Figure 11:
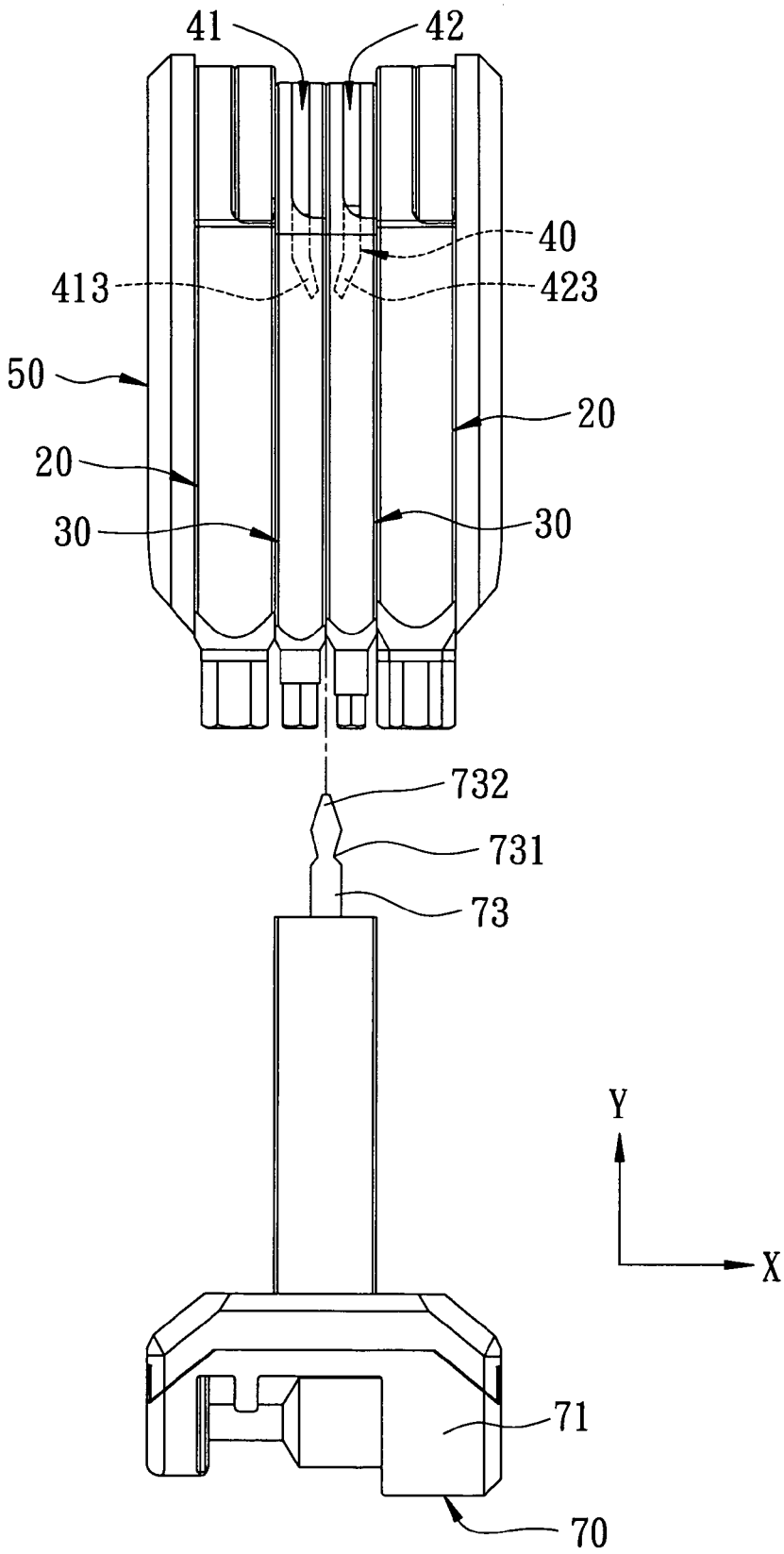
FIG. 11 is a front view of the preferred embodiment, illustrating the chain repair tool in an un-retained state.

As shown in FIG. 3 and FIG. 11, to use the chain repair tool 70, the chain repair tool 70 must be moved to an un-retained state by pulling the base 71 in the second direction (Y) away from the clamping unit 40 to overcome the forces of the clamping portions 413, 423 of the first and second clamping members 41, 42 such that the restricted neck 731 is released from the clamping portions 413, 423.

As shown in FIG. 12, when it is desired to repair the bike chain 90, the chain repair tool 70 is positioned such that the bike chain 90 is disposed on the chain-positioning seat 74. The pin-removing component 76 is then moved toward the chain-positioning seat 74 by turning the pin-removing component 76 relative to the internally threaded seat 75, until the urging portion 762 urges the pin 91 off from two adjacent link plates 92 for separating the link plates 92 from each other. The bike chain 90 is then reassembled in any manner known to those skilled in the art. Since the feature of the present invention does not reside in the technique of bike chain repair, further details thereof are omitted herein.

In conclusion, the tool set according to the present invention has the following advantages:

1. The first and second tool units 20, 30 are independently rotatable relative to the pivot unit 60, i.e., one can be rotated without rotating the other, to facilitate easy use of the tool set.

2. Since the first connecting heads 24 of the first tool members 21 of each of the first tool units 20 are aligned in the first direction (X) and have a total width (w2+w2) that equals the first width (w1) of the first tool members 21, while the first tool bodies 22 of the first tool members 21 of each of the first tool units 20 are aligned in the third direction (Z) and have a total thickness (t1+t1) that equals the first outer diameter (d1) of the first connecting heads 24 of the first tool members 21, the tool set is compact to facilitate storage thereof.

3. The retaining portion 73 of the chain repair tool 70 is clamped by the clamping portions 413, 423 of the first and second clamping members 41, 42 when the chain repair tool 70 is in a retained state such that a bike rider does not need to carry a separate chain repair tool, as in the prior art, thereby facilitating transport of the tool set.

While the present invention has been described in connection with what is considered the most practical and preferred embodiment, it is understood that this invention is not limited to the disclosed embodiment but is intended to cover various arrangements included within the spirit and scope of the broadest interpretation and equivalent arrangements.

What is claimed is:

1. A tool set comprising:

a pivot unit extending in a first direction; and at least two first tool units, each of which includes two first tool members attached rotatably to said pivot unit, each of said first tool members including a first tool head, a first tool body connected to said first tool head and extending in a second direction transverse to the first direction, and a first connecting head connected to said first tool body and having said pivot unit extending rotatably therethrough, said first tool body of each of said first tool members having a first width in the first direction, and a first thickness in a third direction transverse to the first and second directions, said first connecting head of each of said first tool members having a second width in the first direction not greater than one-half of the first width, and a first outer diameter not smaller than twice the first thickness, said first tool members of each of said first tool units being disposed adjacent to each other such that said first tool bodies of said first tool members are disposed side by side in the third direction, and such that said first connecting heads of said first tool members are disposed side by side in the first direction.

2. The tool set as claimed in claim 1, further comprising at least two second tool units disposed between two of said first tool units, each of said second tool units including two second tool members attached rotatably to said pivot unit, each of said second tool members including a second tool head, a second tool body connected to said second tool head and extending in the second direction, and a second connecting head connected to said second tool body and having said pivot unit extending rotatably therethrough, said second tool body of each of said second tool members having a third width in the first direction, and a second thickness in the third direction, said second connecting head of each of said second tool members having a fourth width in the first direction not greater than one-third of the third width, and a second outer diameter not smaller than twice the second thickness, said second tool members of each of said second tool units being disposed adjacent to each other such that said second tool bodies of said second tool members are aligned in the third direction, and such that said second connecting heads of said second tool members are aligned in the first direction.

3. The tool set as claimed in claim 2, wherein:

said second tool bodies of said second tool members of said second tool units cooperate with said first tool bodies of said first tool members of said two of said first tool units to confine a retaining space thereamong;

said tool set further comprising a clamping unit disposed in said retaining space, said clamping unit including first and second clamping members, each of said first and second clamping members having a clamping portion, a clamp body connected to said clamping portion and extending in the second direction, and a pivot connecting portion connected to said clamp body and having said pivot unit extending rotatably therethrough, said pivot connecting portion of each of said first and second clamping members having a fifth width in the first direction not greater than one-third of the third width, and being disposed between said second connecting heads of said second tool members of a respective one of said second tool units.

4. The tool set as claimed in claim 3, wherein:

said clamping portions of said first and second clamping members extend toward each other in said retaining space;

said tool set further comprising a chain repair tool extended into said retaining space and clamped removably by said clamping portions of said first and second clamping members.

5. The tool set as claimed in claim 4, wherein said chain repair tool includes:

a base;

a retaining portion connected to said base, extended removably into said retaining space, and clamped removably by said clamping portions of said first and second clamping members;

a chain-positioning seat formed on said base;

an internally threaded seat formed on said base and spaced apart from said chain-positioning seat; and a pin-removing component mounted threadedly on said internally threaded seat and operable for movement toward and away from said chain-positioning seat.

6. The tool set as claimed in claim 5, wherein said retaining portion of said chain repair tool is formed with a tapering tip and a restricted neck proximate to said tapering tip to engage said clamping portions of said first and second clamping members.

7. The tool set as claimed in claim 1, further comprising a cover member that includes two wing portions mounted rotatably to said pivot unit, extending in the second direction, and having said first tool units disposed therebetween; and a connecting portion extending in the first direction and interconnecting said wing portions.

* * * * *